United States Patent [19]

Komiyama et al.

[11] 4,113,167

[45] Sep. 12, 1978

[54] EXHAUST SYSTEM MEANS FOR AUTOMOBILES

[75] Inventors: Yoshiro Komiyama, Okazaki; Katsumi Kondo, Toyota; Mototsugu Koyama, Toyota; Masaaki Nagaoka, Toyota; Tsuneo Uchida, Toyota, all of Japan

[73] Assignee: Toyota Jidosha Kogyo Kabushiki Kaisha, Toyota, Japan

[21] Appl. No.: 781,408

[22] Filed: Mar. 25, 1977

[30] Foreign Application Priority Data

Nov. 16, 1976 [JP] Japan ..... 51-137988

[51] Int. Cl.[2] ..... B23K 31/02; B23K 28/00

[52] U.S. Cl. ..... 228/176; 228/199; 29/527.4

[58] Field of Search ..... 228/199, 176, 214, 225; 29/527.2, 527.4; 427/423

[56] References Cited

U.S. PATENT DOCUMENTS

| | | | |
|---|---|---|---|
| 2,937,371 | 3/1960 | Hays | 29/527.4 |
| 3,224,008 | 12/1965 | McNelly | 228/214 X |
| 3,640,755 | 2/1972 | Barth | 427/423 X |
| 3,827,139 | 8/1974 | Norteman | 228/125 X |

*Primary Examiner*—Al Lawrence Smith
*Assistant Examiner*—K. J. Ramsey
*Attorney, Agent, or Firm*—Stevens, Davis, Miller & Mosher

[57] ABSTRACT

An exhaust system means for automobiles composed of a plurality of members joined together at joining portions by welding. The welded portion and a surrounding portion are covered with a protective metal layer formed by spraying a molten metal thereon.

2 Claims, 5 Drawing Figures

EXHAUST SYSTEM MEANS FOR AUTOMOBILES

BACKGROUND OF THE INVENTION

1. Field of the Invention

The present invention relates to an exhaust system means for automobiles and a method of producing the exhaust system means. In more detail, the present invention relates to a corrosion-resisting exhaust system means for automobiles and a method of producing such an exhaust system means.

2. Description of the Prior Art

In coping with an increase of the exhaust gas temperature caused by the strict regulations with regard to the exhaust gas purification in recent years, the exhaust system means for automobiles such as an exhaust pipe or a muffler is now more frequently made of a steel material having an anti-corrosive surface layer such as an aluminum plating or zinc plating in order to ensure a long life. By employing these materials the durability of the exhaust system means is substantially improved when compared with the case of employing a normal steel material.

However, an exhaust system for automobiles generally comprises a lot of joining portions such as a joining portion of an exhaust pipe and a muffler, a joining portion of a pipe end and a flange, a joining portion of an exhaust pipe or a muffler and a supporting member which mounts the exhaust pipe or the muffler to the body of an automobile, and since these joining portions are generally joined by welding, there is a problem that the welded portions and their adjacent portions are relatively soon corroded. This is due to the fact that the welding bead itself is rather poor in corrosion resistance and that the anti-corrosive surface layer located adjacently around the welded portions is broken, cracked or deteroriated by the heat generated in the welding process. The problem of corrosion at the welded portions and the surrounding portions is particularly serious in cold districts such as the North American and European districts, because in these districts rock salt is sprinkled on the road in the winter season for preventing the freezing of the road surface, the salt becoming attached to the welded and surrounding portions while the automobile is running and acting as a corrosion accelerator for these portions.

In order to avoid local corrosion in the welded and surrounding portions, it has been contemplated to join the members in the exhaust system by clamping or caulking instead of welding or to apply a metal powder painting or an anti-corrosive painting to the welded and surrounding portions. However, a joint formed by clamping or caulking in an exhaust system will cause a problem with regard to gas tightness and, furthermore, such a joint is inferior in mechanical strength. The anti-corrosive painting is a problem with regard to its reliability and durability because the paint film can be easily removed when a small mechanical force has been applied thereto. It has also been contemplated to produce the entire exhaust system of a highly corrosion-resisting material such as a stainless steel and to weld them together by employing a similar highly corrosion-resisting welding material. However, this idea is not practical for the automobile industry because of its high cost.

SUMMARY OF THE INVENTION

It is therefore the object of the present invention to deal with the aforementioned problem with regard to the conventional exhaust system means for automobiles and to provide an improved exhaust system means for automobiles and a method of producing the exhaust system means which incorporates a highly reliable anti-corrosive means without undesirably increasing the manufacturing costs.

In accordance with the present invention, the above-mentioned object is accomplished by an exhaust system means for autombiles comprising at least two members joined together at a joining portion thereof by welding, said members each being made of a steel material having an anti-corrosive surface layer, and a protective layer provided on the welded joining portion and a surrounding portion by spraying a molten metal thereon, and a method of producing the above-mentioned exhaust system means comprising the steps of welding said members together at said joining portion and of spraying a molten metal on said welded joining portions and the surrounding portions while said welded joining portions are still hot.

By spraying a molten metal on the welded joining portions and the surrounding portions, these portions are postively covered by an anti-corrosive metal layer and the local corrosion due to the damage of the originally provided anti-corrosive surface layer is extensively avoided. The exhaust system means of the present invention may be produced by using the same steel material having an anti-corrosive surface layer such as used for the conventional exhaust system means. The spraying application of a molten metal can be done at a relatively low cost. Therefore, the present invention does not incur any substantial increase in manufacturing costs of the exhaust system means.

When a molten metal is sprayed on a welded joint portion and the surrounding portion while these portions are still hot by utilizing the heat generated in the proceeding welding process, the spraying process may be applied without any preparatory processes such as degreasing, shot-blasting and preheating processes. In this connection it is sufficient that a part on which the molten metal is sprayed is as hot as 200° C. or more.

When the molten metal spraying process is performed simultaneously with the welding process for a relatively small object such as an exhaust system means for automobiles for the purpose of utilizing the heat generated in the welding process, the position where the welding process is performed is located relatively close to the position where the molten metal spraying process is performed and, because of this, an air current generated by the spraying process blows against the welding portion and interferes with the welding process and/or causes a rough surface of the welded portions.

Therefore, the present invention further proposes a method of producing an exhaust system means for automobiles which comprises at least two members joined together at a joining portion thereof by welding, said members each being made of a steel material having an anti-corrosive surface layer, wherein the method comprises the steps of welding said members together at said joining portion and of spraying a molten metal on said welded joining portion and a surrounding portion, said welding and spraying processes being simultaneously performed to apply them in series to a particular portion of said members by continuously shifting said members relative to a welding means and a spraying means, wherein a wind screen is provided between said welding means and said spraying means. In accordance with this method, the manufacturing process of exhaust system means for automobiles is very much simplified and accomplishes a high working efficiency with a corresponding low manufacturing cost.

BRIEF DESCRIPTION OF THE DRAWING

In the accompanying drawing.

DESCRIPTION OF THE PREFERRED EMBODIMENT

The present invention will now be described in more detail with respect to some preferred embodiments thereof with reference to the accompanying drawing.

Figure 1:
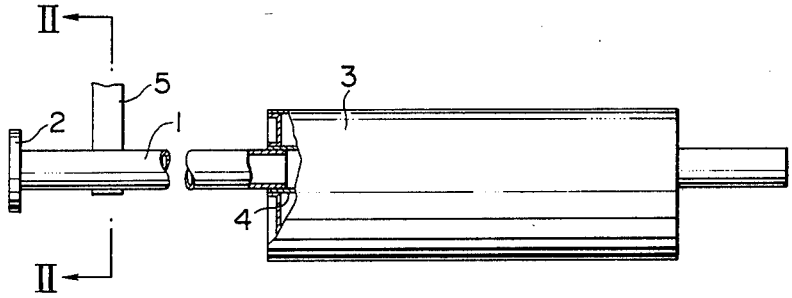
FIG. 1 is a rather diagrammatical view showing a usual exhaust system means for automobiles.

Referring to FIG. 1 showing an example of the exhaust system means commonly used for automobiles, 1 designates an exhaust pipe having a flange 2 attached at an end portion thereof, while another end of the pipe is inserted into a corresponding tube member 4 extending from a muffler 3. The pipe 1 and the tubular member 4 are joined together by welding. A support element 5 is connected to a middle portion of the exhaust pipe by welding in a manner such as better shown in FIG. 2. The exhaust system means is made of a steel material having an anti-corrosive surface layer such as an aluminum plating or a zinc plating.

Figure 3:
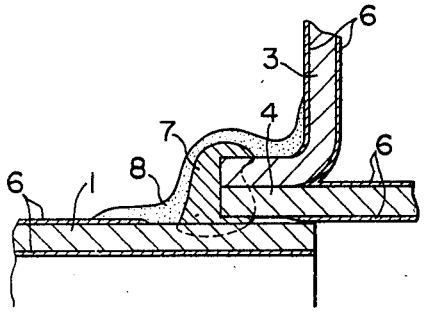
FIG. 3 is an enlarged diagrammatical sectional view showing a joining portion of a muffler and an exhaust pipe wherein the welded portion and a surrounding portion is covered by a protective metal layer formed by spraying a molten metal.

FIG. 3 shows a joining portion formed in the exhaust system means shown in FIG. 1, wherein the exhaust pipe 1, the inlet pipe 4 and a flange portion of a sidewall of the muffler 3 are joined together by welding. In FIG. 3, 6 designates an anti-corrosive layer provided on the outer and inner surface of a steel material forming these members and 7 is a welding bead layer. It is usual that the anti-corrosive surface layer disappears at the welding portion and its surrounding portion. In accordance with the present invention, these portions are covered by a protective layer 8 formed by spraying a molten metal thereon.

Several examples of the present invention will be shown in the following.

EXAMPLE 1

An end portion of an exhaust pipe was inserted into an inlet pipe of a muffler as generally shown in FIG. 1 and the joining members were welded together by employing the art of the carbon-dioxide welding. Each 8 assemblies of this structure have been prepared by using a steel material having an aluminium plating and a steel material having a zinc plating. The outer diameter and the thickness of the exhaust pipe are 38mm and 1.2mm respectively.

After the completion of the welding process, the welded portion and a surrounding portion of each 7 assemblies made of the aluminum-plated steel material and the zinc-plated steel material were degreased, shot-blasted by employing glass beads and preheated to a temperature of 200°–300° C. Then, with respect to the assemblies made of the aluminum-plated steel material, an aluminum powder smaller than 250 mesh was sprayed by employing a plasma spray means at the welded and surrounding portions so as to form thereon a molten metal layer of the thickness of 10,50, 100,300,500 1000 and 1500 microns, whereas with respect of the assemblies made of the zinc plated steel material, a zinc powder smaller than 250 mesh was sprayed at the welded and surrounding portions by employing the same plasma spray means so as to form a molten metal layer of the same series of thicknesses.

The samples having bare welded and surrounding portions and the samples having the molten metal layers of various thicknesses were subjected to a salt water spraying test for 300 hours in accordance with the Japanese Industrial Standard (JIS Z-2371), and thereafter the samples were put in an electric furnace maintained at 400° C. for 5 minutes, and immediately thereafter the samples were soaked in water at room temperature for 30 seconds to be cooled down. This process was repeated 50 times.

Furthermore, an exhaust pipe and a muffler made of the same aluminum-plated steel material were joined by welding in the same manner as the above samples and the welded and surrounding portions were covered by a molten metal layer of 200–300 microns formed by spraying a mixture of the aluminum powder and the zinc powder by the same plasma spray means. This sample was subjected to the same treatment as described above.

These samples were examined with regard to the corrosion and the external appearance. The results are shown in Table 1.

TABLE 1

| Samples | | Corrosion and External Appearance |
|---|---|---|
| Aluminium-plated steel Bare welded portion | | Heavy red rust. Max. corr. depth: 100 μ |
| Zinc-plated steel Bare welded portion | | Heavy red rust. Max. corr. depth: 150 μ |
| Aluminium | 10 μ | No red rust. Sprayed layer has disappeared. No corrosion of steel base. |
| Sprayed welded portion | 50 μ | No red rust. A little reduction of sprayed layer. No exfoliation. No corrosion of steel base. |
| | 100 μ | " |
| | 300 μ | " |
| | ≧500 μ | " |
| Zinc Sprayed Welded Portion | 10 μ | |
| | 50 μ | Substantially the same as the aluminium sprayed welded portion. |
| | 100 μ | |
| | 300 μ | |
| | ≧500 μ | |
| Aluminium Zinc + sprayed welded portion | 200–300 μ | No red rust. A little reduction of sprayed layer. No exfoliation. No corrosion of steel base. |

As apparent from Table 1, the corrosion resistance is more improved when the sprayed layer is thicker regardless whether the sprayed layer is made of aluminum or zinc. However, a sprayed layer of about 10 microns is sufficient to accomplish the object of the present invention. The adhesion of the sprayed layer was good regardless of its thickness.

EXAMPLE 2

Figure 4:
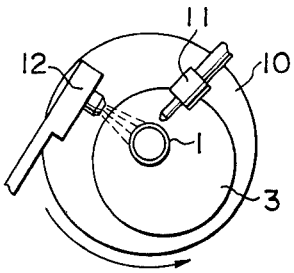
FIG. 4 is a diagrammatical plan view showing an embodiment of the method of the present invention; and, FIG. 5 is a view similar to FIG. 4 showing another embodiment of the present invention.

An exhaust pipe 1 made of an aluminum-plated steel material having outside diameter of 38mm and thickness of 1.2mm was inserted into the inlet pipe of muffler 3 made of an aluminum-plated steel material as shown in FIG. 1 and the assembly was laid on a turn table 10 as shown in FIG. 4. The assembly was rotated around the central axis of the exhaust pipe 1 at the rate of 1 revolution per 12 seconds while the joining portion of the muffler and the exhaust pipe was welded by employing a carbon dioxide gas arc welder. After a lapse of 4 seconds from the start of the welding process, molten aluminum was sprayed on the welded portion and a surrounding portion by employing a gas-type molten metal sprayer 12 loaded with an aluminum wire of 1.45 mm diameter. Therefore, the molten metal spraying process was finished after a lapse of 4 seconds from the completion of the welding process.

In this case, by applying the molten metal spraying process immediately after welding, preparatory processes such as degreasing, shot-blasting and preheating could be omitted. However, the welding portion was subjected to an air current generated by the molten metal spraying, whereby the welding bead showed a rough surface including convex and concave portions and the air current interfered with the welding process. On the other hand, the molten metal layer itself was not sprayed uniformly and there were left some portions where the molten metal layer was not formed.

EXAMPLE 3

Figure 5:
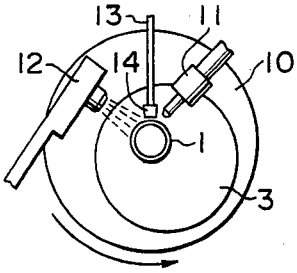

In the same arrangement of the welder 11 and the sprayer 12 as that shown in FIG. 4 a wind screen 14 made of a heat resistive rubber was placed between the welder and the sprayer as shown in FIG. 5, said screen being suspended by a support 13. The welding and molten metal spraying processes were performed in the same condition as in Example 2. A perfect welded portion having a uniform welded bead layer was obtained while a uniform and well stuck aluminum layer was formed.

EXAMPLE 4

Figure 2:
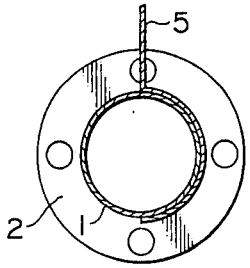
FIG. 2 is an enlarged sectional view along line II—II in FIG. 1.

Exhaust pipes 1 made of an aluminum-plated steel material and a zinc-plated steel material and supports made of an aluminum-plated steel material and a zinc-plated steel material were joined together, respectively, by employing a carbon dioxide gas arc welder in a manner such as shown in FIG. 2. Immediately thereafter, the welded portion and a surrounding portion of the assemblies were covered by a molten metal layer applied by spraying, aluminum having been sprayed for the assemblies made of the aluminum-plated steel material while zinc was sprayed for the assemblies made of the zinc-plated steel material, wherein the lapse of time from the welding to the spraying was changed in various manners to change the temperature condition of the welded and surrounding portions for the spraying process. The molten metal layer was formed as thick as 200–300 microns. The welded and surrounding portions were cut off from the assemblies and were put in an electric furnace maintained at 400° C. for 5 minutes. Immediately thereafter, the samples were soaked in water at room temperature for 30 seconds to be cooled down. This process was repeated 50 times. Thereafter, the sprayed layer was examined with respect to its external appearance. The results are shown in Table 2.

TABLE 2

| Kind of spray and temperature | | External appearance of sprayed layer |
|---|---|---|
| | >500° C | No exfoliation of sprayed layer |
| Alum- | 400–500° C | " |
| inium | 300–400° C | " |
| Spray | 200–300° C | " |
| | 100–200° C | Sporadically exfoliated (30%) |
| | Room Temp. - 100° C | Almost exfoliated |
| Zinc | >300° C | No exfoliation of sprayed layer |
| Spray | 200–300° C | " |
| | 100–200° C | Sporadically exfoliated (40%) |
| | Room Temp - 100° C | Almost exfoliated (90%) |

From Table 2 it will be understood that when the spraying is applied while the process is above 200° C., there is no problem about the adhesion of the sprayed layer onto the base portion in both aluminum and zinc spraying.

EXAMPLE 5

An exhaust means such as shown in FIG. 1 was prepared from an exhaust pipe 1 made of an aluminum-plated steel material, a flange 2 made of a hot rolled steel plate, a muffler 3 made of an aluminum-plated steel material and a support member 5 made of an aluminum-plated steel material by welding them together at joining portions therebetween. The welded and surrounding portions were covered by a well adhered aluminum-sprayed layer of 200–300 microns thick formed by a gas-type automated sprayer when the portions were at 300°–550° C.

Such an assembly and another similar assembly not covered by any aluminum-sprayed layer were mounted in automobiles which were driven on a paved road at the speed of 60Km/h for 2 hours, and thereafter, 5% sodium chloride water solution was sprayed onto the exhaust system means at room temperature for 30 minutes, and thereafter the automobiles were again driven on a paved road at the speed of 60Km/h for 2 hours. Then the exhaust system means were removed from the automobiles and were placed in a closed stainless steel box enclosing an atomosphere at a temperature of 49° ± 5° C. and a humidity of 85 ± 5% for 5 hours. The above process was repeated 500 times. This is to simulate the actual running condition to which the exhaust system means for automobiles is subjected in a cold district. The results are shown in Table 3.

TABLE 3

| Samples | Bare Welded portion | | Aluminium sprayed | |
|---|---|---|---|---|
| Welded portion | External appearance | Max. corr. depth in exhaust pipe (μ) | External appearance | Max. corr. depth in exhaust pipe (μ) |
| Flange Exhaust Pipe | Heavy red rust | 500 μ (base attacked) | Red rust on flange, white rust on ex. pipe | 150 μ (sprayed layer only) |
| Support-Ex. pipe | " | 400 μ | White rust | " |
| Exhaust pipe | " | 600 μ | White rust | " |

TABLE 3-continued

| Samples | Bare Welded portion | | Aluminium sprayed | |
|---|---|---|---|---|
| Welded portion | External appearance | Max. corr. depth in exhaust pipe (μ) | External appearance | Max. corr. depth in exhaust pipe (μ) |
| muffler | | | | |

As apparent from Table 3, by contrast to the heavy corrosion of the base material in the order of 400–600 microns caused in the bare welded portion of the conventional exhaust system means, the aluminum - sprayed exhaust system means of the present invention suffers only a surface corrosion of the sprayed layer.

From the foregoing it will appreciated that the durability of the exhaust system means for automobiles is very much improved by the application of the present invention.

Although the invention has been described with reference to some particular embodiments thereof, it is to be understood by those skilled in the art that various modifications can be made with respect to these embodiments without departing from the spirit of the invention.

We claim:

1. In a method of producing an exhaust system for automobiles which comprises at least two members joined together by welding along an arcuate or circular joining portion having a relatively small radius of curvature, said members each being made of a steel material having an anti-corrosive surface layer, wherein the improvement comprises the processes of rotating a preassembly of at least said two members around the center of curvature of said arcuate or circular joining portion, welding said two members together along said joining portion by employing a stationary welder so as to form a weld seam along said joining portion as said preassembly rotates, and spraying a molten metal onto said weld seam just after it has been formed and while it is still hot by employing a stationary molten metal sprayer located adjacent to said welder at its rearward position as seen in the moving direction of said weld seam, and preventing the turbulence of air caused by the molten metal spraying from affecting the welding process by placing a wind screen between said welder and said molten metal sprayer.

2. The method of claim 1, wherein said two members are an exhaust pipe and a muffler and these members are joined together in such a manner that an end portion of said exhaust pipe is inserted into a corresponding flanged opening of said muffler having an annular flange portion and that said annular flange portion is welded to said end portion of said exhaust pipe.

* * * * *